US005944984A

United States Patent [19]

Benguigui et al.

[11] Patent Number: 5,944,984

[45] **Date of Patent: *Aug. 31, 1999**

[54] SOLVENT DEASPHALTING UNIT AND METHOD FOR USING THE SAME

[75] Inventors: Ilan Benguigui, Tel Aviv, Israel; Richard L. Hood, Edmond, Okla.; Philip B. Rettger, Walnut Creek, Calif.

[73] Assignee: Ormat Industries Ltd., Yavne, Israel

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/618,570

[22] Filed: Mar. 20, 1996

[51] Int. Cl.[6] ..... C10C 3/00; C10C 1/18; B01D 11/00

[52] U.S. Cl. ..... 208/309; 196/14.52

[58] Field of Search ..... 196/14.52; 208/309

[56] References Cited

U.S. PATENT DOCUMENTS 4,017,383 4/1977 Beavon ..... 208/309
4,721,557 1/1988 Staggs ..... 208/68
4,784,753 11/1988 Hotier et al. ..... 208/309
5,258,117 11/1993 Kolstad et al. ..... 208/309
5,804,060 9/1998 Benguigui et al. ..... 208/309

*Primary Examiner*—Nina Bhat
*Attorney, Agent, or Firm*—Nath & Associates; Gary M. Nath; Jerald L. Meyer

[57] ABSTRACT

An evaporative solvent recovery section operates on a plurality of liquid product streams including a liquid stream of deasphalted oil and solvent, and a liquid stream of asphaltene and solvent produced by a solvent deasphalting unit. Heat is added to one of the streams for producing a heated liquid product stream that is flashed to produce a stream of vaporized solvent, and a stream of reduced solvent liquid product. The stream of reduced solvent liquid product is further processed, without the addition of a significant amount of heat, to vaporize substantially all of the remaining solvent therein, and heat contained in the stream of vaporized solvent is recovered by expanding the stream in a vapor turbine.

28 Claims, 5 Drawing Sheets

SOLVENT DEASPHALTING UNIT AND METHOD FOR USING THE SAME

TECHNICAL FIELD

This invention relates to a method of and means for operating fractionating units, and more particularly, to a solvent deasphalting unit having an evaporative solvent recovery section, and to a method for using the section to reduce heating requirements.

BACKGROUND OF THE INVENTION

A solvent deasphalting unit associated with an oil refinery mixes residual oil produced by a petroleum refinery with a light hydrocarbon solvent such as propane, iso- or normal butane, iso- or normal pentane, or mixtures thereof, for producing two liquid product streams. One stream is substantially free of asphaltenes and contains deasphalted oil (DAO) and solvent, and the other stream contains asphaltene and solvent within which some DAO is dissolved. These product streams are applied to a solvent recovery section which extracts most of the solvent from the product streams. The resultant solvent-free DAO is returned to the refinery for conversion to gasoline, jet fuel, etc.; and the resultant solvent-free asphaltene can be combined with dilutent, such as diesel fuel, for conversion to residual fuel.

In some installations, the solvent recovery section includes a supercritical solvent recovery section that removes a large percentage of solvent from the product streams, followed by an evaporative solvent recovery section that removes the balance of solvent. In other installations, only an evaporative solvent recovery section is used. In both cases, the output of the evaporative solvent recovery section is DAO product and asphaltene product having acceptable levels of solvent (e.g., 0.05% by weight).

In an evaporative solvent recovery section, each of the liquid product streams of DAO and solvent, or asphaltene and solvent is first flashed to produce a vaporized solvent stream, and a reduced solvent liquid product stream. Each of the reduced solvent liquid product streams so produced are then subjected to serial flashing and/or stripping until the final product stream is free of solvent to the desired degree. The vaporized solvent produced in this manner is condensed and re-used.

In order to reduce the amount of heat lost as a result of the condensation of the vaporized solvent, the temperature at which flashing operations are effected is kept as low as possible. Thus, the flash drums to which the solvent containing product streams are applied operate to produce solvent vapor at about 220° F. Heat contained in these vapors is of such low quality that economic recovery is not practical; and as a consequence, such heat is extracted from the solvent by air or water cooling, and is lost to the environment.

If the temperature of a product stream applied to the lead flash drum of an evaporative solvent recovery section is less than about 250–300° F., which will effect the production of vaporized solvent at the desired temperature of about 220° F., heat must be added to the product stream before flashing. All of the added heat contained in the solvent that flashes in the drum will be lost to the environment. After flashing is effected, the reduced solvent product stream extracted from the bottom of the drum eventually is applied to a stripper which must operate at a temperature high enough to ensure that only a minimum amount of solvent is retained in the final product stream. For example, if the desired residual solvent in the final product is to be less than about 0.05% by weight, the stripper must operate at about 525° F. to ensure vaporization of the solvent. Since the temperature of the reduced solvent product stream leaving the preceding flash drum is about 250–300° F., heat must be added to the product stream between a succeeding stripper and a preceding flash drum. Again, most of this added heat is lost to the environment when the vaporized solvent produced by the stripper is condensed.

U.S. patent application Ser. No. 08/572,185, filed Dec. 13, 1995 (the disclosure of which is hereby incorporated by reference) discloses a method of and apparatus for recovering heat contained in the vaporized solvent produced by the first stage of flashing by expanding the vaporized solvent in an organic vapor turbine. This application also discloses recovery of heat in the vaporized solvent produced by the stripping stage by transferring heat to an organic fluid that constitutes the working fluid of an organic vapor turbine that operates on the Rankine cycle.

This approach reduces the heat consumption of an evaporative solvent recover section of a solvent deasphalting unit. An object of the present invention is to provide a method of and means for reducing even further the net heat used in an evaporative solvent recovery section of a solvent deasphalting unit.

BRIEF DESCRIPTION OF THE INVENTION

In accordance with the present invention, a method is provided for operating a solvent recovery section of a solvent deasphalting unit that produces a plurality of liquid product streams comprising a liquid stream of deasphalted oil and solvent, and a liquid stream of asphaltene and solvent such that the heat requirement of the solvent deasphalting unit is reduced. The method comprises supplying to at least one of the liquid product streams having solvent substantially all of the heat for the removal of the solvent from said at least one of the liquid product streams having solvent present and producing a heated liquid product stream; flashing the heated liquid product stream for producing a stream of vaporized solvent, and a reduced solvent liquid product stream; preheating with the stream of vaporized solvent at least one of the liquid product streams prior to flashing it producing a heat depleted stream of vaporized solvent; and subjecting the reduced solvent liquid product stream to at least one additional stage of flashing, each additional stage of flashing operating in a preferred temperature range of about 0 to 30° C. less than the operating temperature of the first flashing stage, and at a pressure which is lower than the pressure of the first flashing stage, but higher than the vapor pressure of the solvent at a temperature slightly above ambient temperature, to produce at least one further stream of vaporized solvent and at least one further reduced solvent liquid product stream. Usually, a plurality of further streams of vaporized solvent and a plurality of further reduced solvent liquid product streams will be produced.

Preferably, the heat depleted stream of vaporized solvent is expanded in a solvent vapor turbine for producing power and a stream of expanded vaporized solvent; and the stream of expanded vaporized solvent is cooled and condensed. In addition, the cooling and condensing of the stream of expanded vaporized solvent preferably includes transferring heat in the stream of expanded vaporized solvent to an organic fluid that is vaporized as a result for producing a stream of vaporized organic fluid; expanding the vaporized organic fluid in an organic vapor turbine for producing power and expanded vaporized organic fluid; and condensing the expanded vaporized organic fluid to organic fluid condensate. Furthermore, in accordance with the present invention, the further stream of vaporized solvent is preferably supplied to an intermediate stage of the solvent vapor turbine. In solvent deasphalting units not employing a solvent recompression step, solvent from the further reduced solvent liquid product stream is stripped at a temperature preferably within about 30° C. of the temperature of the first flashing to produce a still further vaporized solvent stream and a substantially solvent-free product stream; and the stripped or still further vaporized solvent stream is preferably combined with the stream of expanded vaporized solvent before cooling and condensing the combined stream.

In solvent deasphalting units employing a solvent recompression step, solvent from the further reduced liquid product stream is flashed preferably within about 30° C. of the temperature of the first flashing and at a pressure above the pressure of the solvent drum to produce a still further vaporized solvent stream and another reduced solvent liquid stream; and the still further vaporized solvent stream is preferably combined with the stream of expanded vaporized solvent before cooling and condensing the combined stream.

The substantially solvent-free product stream is flashed preferably within about 30° C. of the temperature of the first flashing to produce another vaporized solvent stream and a further substantially solvent-free product stream and heat in the other vaporized solvent stream can be transferred to an organic fluid that is vaporized as a result for producing a stream of vaporized organic fluid and a stream of heat depleted solvent stream; the vaporized organic fluid in such case being expanded in an organic vapor turbine for producing power and expanded vaporized organic fluid with the expanded vaporized organic fluid being condensed to organic fluid condensate.

Alternatively, the heat in the other vaporized solvent stream can be transferred to air or water in an indirect heat exchanger. Sour water is then separated from the heat depleted solvent stream for producing a stream of cooled solvent vapors which can be compressed with the compressed solvent vapors produced being supplied to a solvent drum or if preferred, heat contained in the compressed solvent vapors can be transferred to an organic fluid for energy extraction. If the flashing and stripping of the liquid product at pressures below the pressure of the solvent drum does not recover a significant amount of solvent, solvent recompression is not required.

In a still further embodiment of the present invention, in light solvent deasphalting units, rather than flashing the further reduced solvent liquid product stream or streams at a pressure lower than the solvent drum pressure, a high pressure solvent stripper or strippers can be used for stripping the products to such low solvent levels so that substantially all further recovery equipment can be eliminated.

Moreover, the present invention comprises providing apparatus for carrying out the above mentioned method steps of the present invention, the apparatus including means for supplying to at least one of the liquid product streams having solvent substantially all of the heat for the removal of the solvent from at least one of the liquid product streams having solvent present for producing a heated liquid product stream; a flash drum for flashing the heated liquid product stream to produce a stream of vaporized solvent, and a reduced solvent liquid product stream; a preheater for preheating with the stream of vaporized solvent the at least one of liquid product streams prior to flashing it producing a heat depleted stream of vaporized solvent; and means for subjecting the reduced solvent liquid product stream to at least one additional stage of flashing, each additional flash drum operating in a preferred temperature range of 0 to 30° C. less than the operating temperature of the first flash drum but higher than the vapor pressure of the solvent at a temperature slightly above ambient temperature, to produce at least one further stream of vaporized solvent and at least one further reduced solvent liquid product stream.

Usually, means will be provided for producing a plurality of further streams of vaporized solvent and a plurality of further reduced solvent liquid product streams. Preferably, a solvent vapor turbine is provided for expanding the heat depleted stream of vaporized solvent to produce power and a stream of expanded vaporized solvent; and cooler apparatus is also provided for cooling and condensing the stream of expanded vaporized solvent. The cooling and condensing apparatus preferably includes a heat exchanger containing organic fluid for transferring heat in the stream of expanded vaporized solvent to the organic fluid that is vaporized as a result for producing a stream of vaporized organic fluid; an organic vapor turbine for expanding the vaporized organic fluid and producing power and expanded vaporized organic fluid; and a condenser for condensing the expanded vaporized organic fluid to organic fluid condensate.

In accordance with the present invention, the preferred operating temperature for flash drums and strippers subsequent to the first flash drum is within about 30° C. of the operating temperature of the first flash drum with the most preferred operating temperature for flash drums and strippers subsequent to the first flash drum being within about 10° C. of the operating temperature of the first flash drum.

The present invention involves a recognition that by supplying all of the heat required for solvent vaporization to the feed furnished to the first flash drum, the heat contained in all of the vaporized solvent is at a high enough temperature level to be recovered for reuse in the solvent deasphalting unit instead of being rejected to the environment. The present invention also involves a recognition that nearly all of the additional heat added by heating before the first flash drum is recovered for reuse inside the deasphalting unit, thereby reducing the amount of external heat that has to be used for solvent vaporization. Consequently, according to the present invention, the respective first flash drums can be operated at a higher temperature than that commonly used in apparatus operated in accordance with the teachings of the prior art. Because these drums operate at temperatures higher than those of the prior art, they extract a larger fraction of solvent vapor than the corresponding drums in the prior art.

Thus, it is to be appreciated that by supplying substantially all of the heat necessary for the removal of the solvent to at least one of the liquid product streams prior to flashing it, and by preheating this liquid product stream prior to flashing with a stream of vaporized solvent produced by flashing the heated liquid product stream solvent, less heat will be used in the solvent recovery section of a solvent deasphalting unit. In addition, if preferred, by providing vapor turbines in the deasphalting units, mechanical power, or alternatively, electricity can be produced. Moreover, according to the present invention, in light solvent deasphalting units, such as those using propane, by using a high pressure solvent stripper or strippers for stripping the products to low solvent levels rather than flashing the further reduced solvent liquid product stream or streams at pressure lower than the solvent drum pressure, substantially all further recovery equipment can be eliminated.

BRIEF DESCRIPTION OF THE DRAWINGS

Embodiments of the present invention are described by way of the example with reference to the accompanying drawings wherein.

DETAILED DESCRIPTION

Figure 1A:
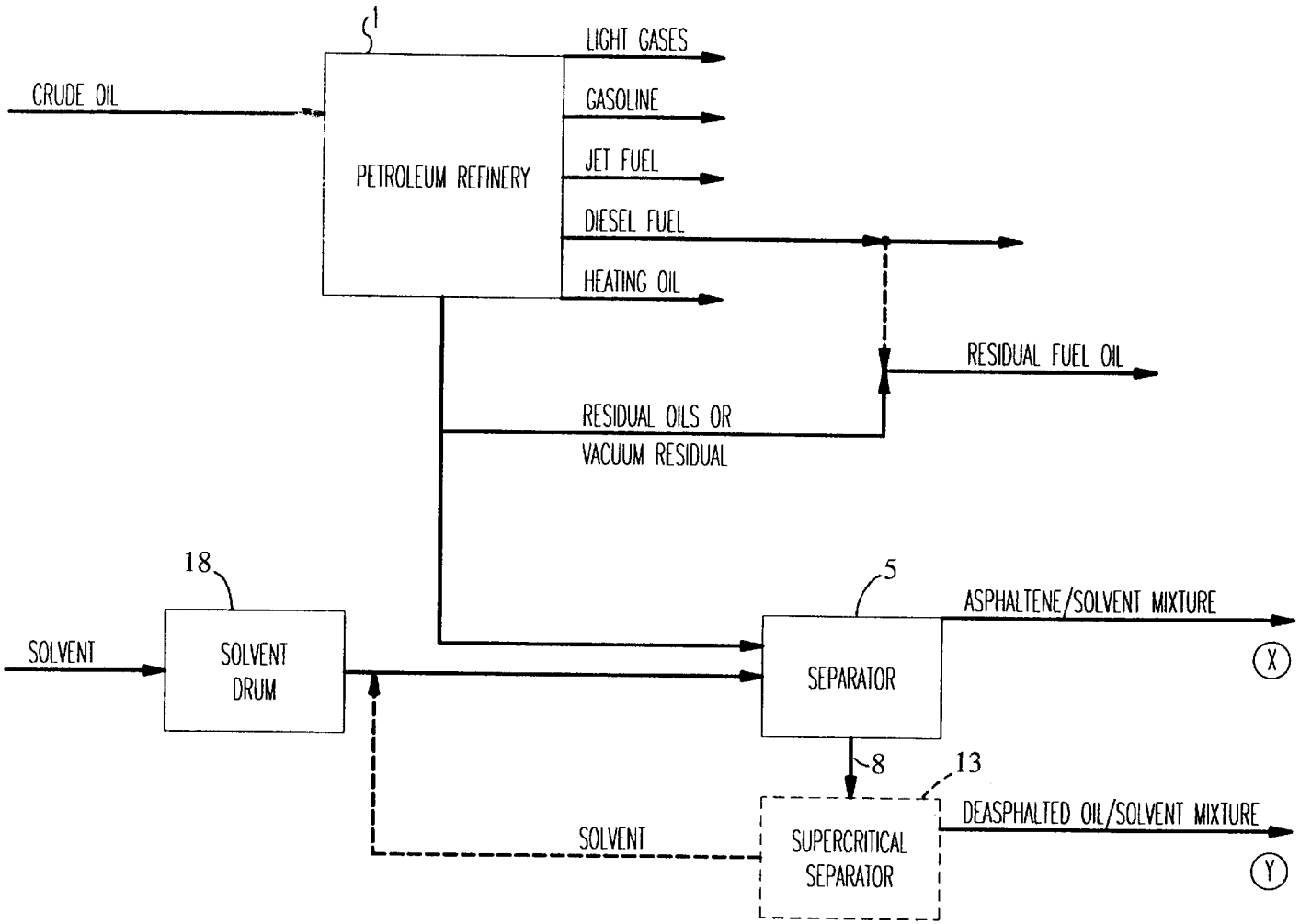
FIG. 1A (PRIOR ART)
FIG. 1A is a block diagram of an oil refinery which produces, from the residual oil, an asphaltene/solvent stream and a deasphalted oil/solvent stream.

Referring now to FIG. 1A, reference numeral 1 designates a typical petroleum refinery that receives crude oil and primarily produces gasoline, jet fuel, diesel fuel, and heating oil. Light gases, which are a by-product of the refinery process are typically sold, or used outside the refinery as fuel. Heavy, viscous residual oil, sometimes referred to as vacuum residual, is also a by-product, and are typically converted to residual fuel and sold to electric utilities by blending with diesel fuel to reduce viscosity. This blending process is indicated by the broken lines connecting the diesel fuel output of the refinery to the residual oil output.

An alternative way to dispose of the residual oil is to utilize a solvent deasphalting unit which involves mixing the residual oil with a light hydrocarbon solvent in a separator to form a mixture that separates into a product stream of asphaltene/solvent and a product stream of deasphalted oil/solvent. The solvent deasphalting unit includes a solvent recovery section which is effective to remove substantially all of the solvent from the product streams, thus recovering the solvent which is returned to the deasphalting unit.

The solvent recovery unit may utilize a supercritical solvent recovery process to remove a great deal of solvent from the DAO product stream; the balance of the solvent being removed by an evaporative solvent recovery process operating on the heavy and any intermediate product streams and the DAO product stream produced by the supercritical solvent recovery process. If supercritical solvent recovery is not used as the primary means to recover solvent from the DAO, an evaporative solvent recovery process would operate on all of the product streams. It is the solvent deasphalting unit and its evaporative solvent recovery process with which the present invention is concerned.

Figure 1B:
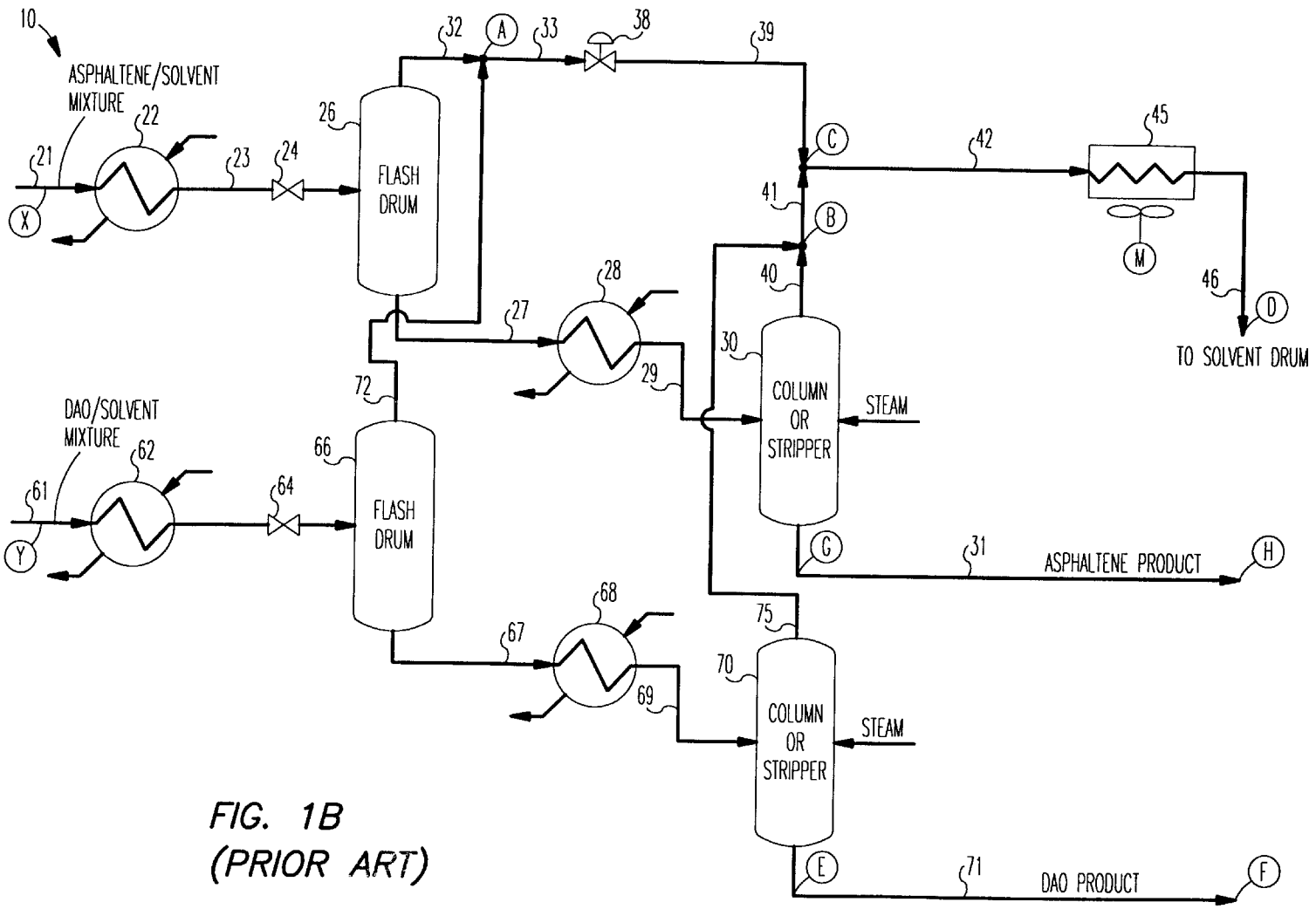
FIG. 1B (PRIOR ART)
FIG. 1B is a block diagram of a conventional evaporative solvent recovery section of a solvent deasphalting unit which receives an asphaltene/solvent stream and a deasphalted oil/solvent stream and recovers the solvent, and produces products in the form of asphaltene, and deasphalted oil.

An evaporative solvent recovery process, which operates on the streams produced as described above conventionally, is shown by reference numeral 10 in FIG. 1B, and is applicable to solvent recovery systems using supercritical and subcritical solvent recovery, or only subcritical solvent recovery. Such a process recovers the solvent so that it can be used again, and produces a product stream of asphaltene, and a product stream of DAO. The DAO fraction is recycled back to the refinery for conversion to gasoline, jet fuel, diesel fuel, and heating oil. The asphaltene fraction may be blended with a lighter, lower viscosity dilutent such as diesel fuel, and converted to residual fuel oil for sale to utilities, or in some cases, sold as solid fuel. For light solvent deasphalting units using a solvent such as propane, where residual solvent is recovered below the pressure of the solvent drum, the vaporized solvent from the strippers has to be repressurized to the pressure of the solvent drum before being condensed.

The liquid asphaltene/solvent stream from the separator is directed via line 21 to asphaltene flash drum 26. In most solvent deasphalting units external heat is added to the product in line 21 by heater 22. Flow control valve 24 in line 23 that is connected to flash drum 26 is used to regulate the flow of asphaltene/solvent to drum 26.

Similarly, the liquid deasphalted oil/solvent stream from the separator is directed via line 61 to deasphalted oil flash drum 66. External heat may be added to the product in line 61 if necessary by heater 62; and flow control valve 64 is used to regulate the flow of deasphalted oil/solvent to drum 66.

At the pressures and temperatures in drums 26 and 66, solvent in each of the drums flashes to a vapor leaving a more concentrated mixture in the drums from which flow reduced solvent liquid product streams. Line 32 carries the overhead solvent vapor stream from drum 26 (i.e., the stream leaving the top of the drum) to junction "A" in line 33 upstream of pressure-reducing valve 38, and line 72 carries the overhead solvent vapor stream from drum 66 to junction "A".

Line 27 carries the more concentrated asphaltene/solvent mixture from the bottom of drum 26 to heater 28 where the mixture is heated and delivered to stripper 30 via line 29. Line 67 carries the more concentrated deasphalted oil/solvent mixture from the bottom of drum 66 to heater 68 where the mixture is heated and delivered to stripper 70 via line 69. Optionally, heaters 28 and 68 can be incorporated into the product strippers, and in some cases are not used.

Each stripper is supplied with steam and operates at a pressure that is slightly higher than the vapor pressure of the solvent at ambient temperature with the exception of solvent deasphalting units using a light solvent, such as propane, where a compressor is needed to raise the pressure of the stripper overhead solvent stream to the vapor pressure of the solvent at ambient temperature. In such units, the stripper operates at substantially atmospheric pressure. Operating the stripper at low pressure strips a maximum amount of the solvent remaining in the more concentrated mixture delivered to the stripper producing at the overhead of the stripper, a stream of steam and vaporized solvent, and at the bottom of the stripper, a stream of the desired product substantially free of solvent. The solvent in the stream of vaporized solvent and steam is recovered by directing the stream to a condenser which condenses the steam and solvent allowing the solvent to separate from the steam condensate, and to be collected in a drum for re-use. The condensate is removed from the drum and purged from the unit.

In the process of recovering the solvent, line 40 carries the stream of vaporized solvent and steam from the overhead of stripper 30 to junction "B" in line 41; and line 75 carries the stream of vaporized solvent and steam from the overhead of stripper 70 also to junction "B". Line 41 carries the combined streams of vaporized solvent and steam from the strippers to junction "C" where the vapors are combined with the combined stream of vaporized solvent flowing in line 39 downstream of pressure reducer 38. The pressure at junction "A" is substantially higher than the pressure at junction "C". The range for the pressure difference between junction "A" and junction "C" is 50 to approximately 450 psig., with a typical value of approximately 200 psig.

Line 42 carries the combined stream of vaporized solvent and steam to condenser 45 (shown as being air-cooled) where the steam and solvent are condensed to liquids and sent to a solvent drum where the condensed steam separates from the solvent. The liquid solvent is returned for re-use in the unit. The steam condensate, or sour water, is purged from the unit.

In the solvent recovery system described above, a considerable amount of heat must be added to the process to make it work; and much of this heat is rejected by the condenser to the atmosphere. The amount of heat rejected to the atmosphere varies from a low value of approximately 145 BTU per pound of solvent evaporated in a propane deasphalting unit, to approximately 265 BTU per pound of solvent evaporated in a solvent deasphalting unit using n-pentane solvent. The amount of heat rejected per pound of solvent increases with the operating temperature of the asphaltene/deasphalted oil separator.

In the prior art, the combined overhead streams were passed through a control valve to reduce the pressure and then passed through an air or water cooler in order to lower the temperature to that required in the solvent drum. The temperature on the flash drum was deliberately kept to a minimum so as not to reject more energy than absolutely necessary to the air or water coolers. Furthermore, in the prior art, solvent removal by the asphaltene stripper and the deasphalted oil stripper is maximized by operation at the highest practical temperature; and this is accomplished by adding heat to the stripper feed or by an external reboiler. Co-pending U.S. patent application Ser. No. 08/572,185 filed Dec. 13, 1995, discloses the use of a turbine to replace pressure reducer 38 for recovering a significant portion of the energy contained in the overhead from the flash drums. This reduces the net energy (i.e., the difference between the heat input and the energy recovered by the turbine) of the solvent recovery unit. According to the present invention, the net energy can be reduced further by eliminating heat exchanger 28 and 68 (FIG. 1B) by which heat is added to the reduced solvent streams produced by the flash drums, and instead, adding all the heat ahead of the flash drums. This improvement is illustrated in solvent recovery section 100 shown in FIG. 2A to which reference is now made.

According to the present invention, the liquid product stream of solvent-containing asphaltene in line 121 is heated by an external source in heat exchanger 124 to form a heated product stream which is applied to lead flash drum 126. The flashing operation effected by drum 126 produces a stream of vaporized solvent in overhead 132, and, in line 127, a reduced solvent liquid product stream containing asphaltene. Similarly, the liquid product stream of solvent-containing DAO in line 161 is heated by an external source in heat exchanger 164 to form a heated product stream which flashes in leading flash drum 166 producing a stream of vaporized solvent in overhead 172, and in line 167, a stream of reduced solvent liquid product containing DAO.

Preheater 122 upstream of heat exchanger 124 receives the stream of vaporized solvent from drum 126 and preheats the asphaltene/solvent liquid product stream in line 121 producing a heat depleted stream of vaporized solvent in line 133. Similarly, preheater 162 upstream of heat exchanger 164 receives the stream of vaporized solvent from drum 166 and preheats the DAO/solvent liquid product stream in line 161 producing a heat depleted stream of vaporized solvent in line 173.

Alternatively, the stream of vaporized solvent in lines 132 and 172 can be combined to form a combined stream of vaporized solvent that can be used to preheat the product stream supplied to leading flash drums 126 and 166. In a still further alternative design, the combined stream of vaporized solvent can be used to preheat the DAO/solvent mixture leaving separator 5 in FIG. 1A ahead of supercritical separator 13 if this apparatus is used in the deasphalting operation.

Figure 2A:
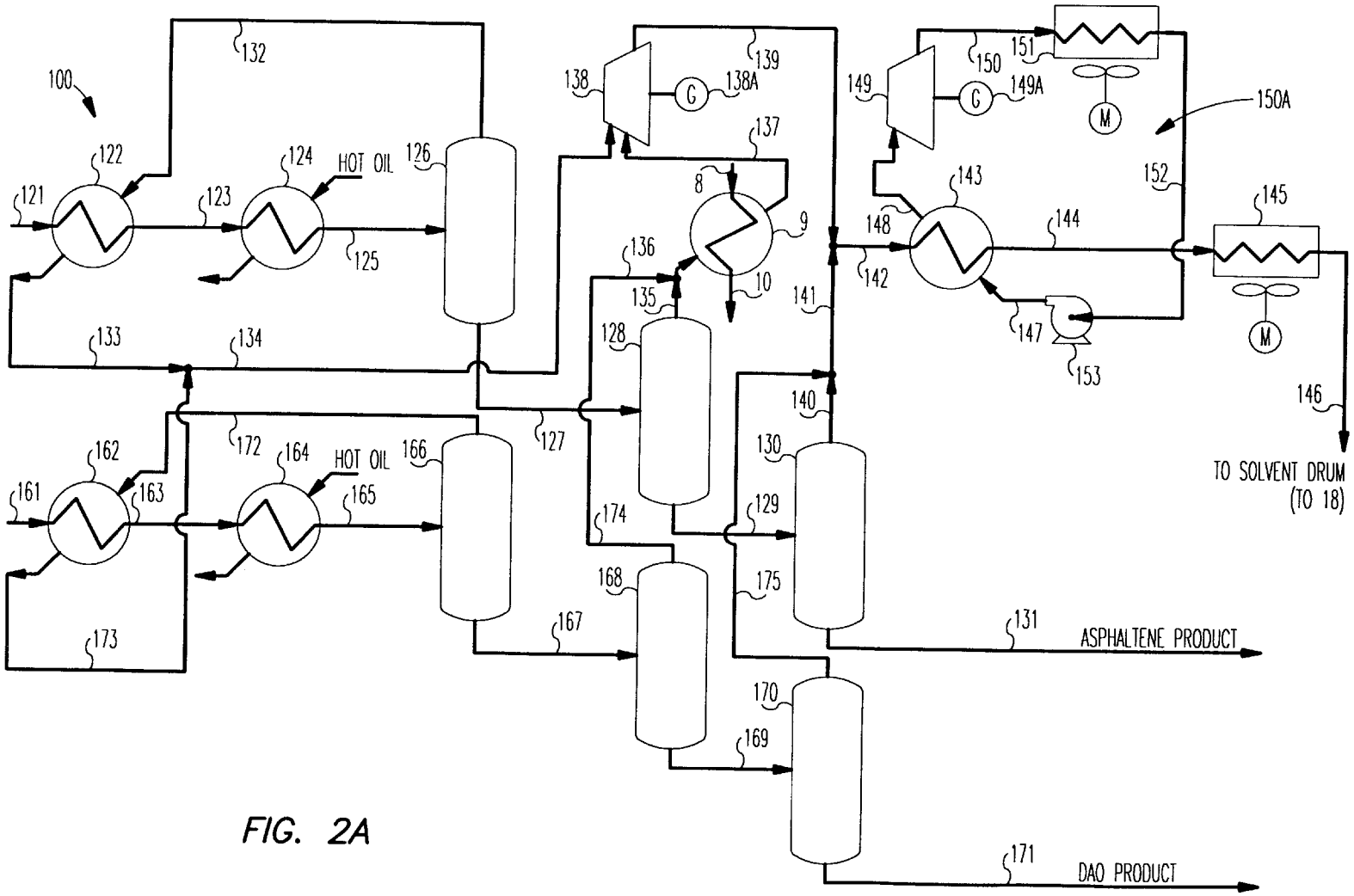
FIG. 2A is a block diagram which represents, in a schematic way an embodiment of the present invention.

Preheating the liquid product streams using vaporized solvent produced by the leading flash drums 126 and 166 as shown in FIG. 2A results in pressures in these drums higher than the pressures in conventional solvent recovery sections typified by FIG. 1B. Consequently, energy recovery in solvent recovery section 100 will be greater than the energy recovery heretofore achieved in the invention disclosed in co-pending U.S. patent application Ser. No. 08/572,185 filed Dec. 13, 1995.

Preferably, heat depleted solvent vapors exiting heat exchanges 122 and 162 are combined in line 134 and then expanded in solvent vapor turbine 138 coupled to generator 138A for producing electric power. A significant portion of the solvent in the reduced solvent asphaltene stream leaving column 126 through conduit 127 can be recovered by passing this stream to second flash drum or column 128, which is operated at the same or slightly lower temperature and pressure than column 126.

Column 128 produces at its overhead, a further stream of vaporized solvent in line 135 at a pressure lower than the pressure of the heat depleted stream of vaporized solvent in line 134. Column 128 also produces a further reduced solvent liquid product stream of asphaltene.

Likewise, a significant portion of the solvent in the reduced solvent DAO stream leaving column 166 through conduit 167 can be recovered in second flash drum or column 168 producing a further stream of vaporized solvent in line 174. By choosing the appropriate operating pressure for columns 128 and 168, the further streams of vaporized solvent leaving the overheads of the columns in conduits 135 and 174 can be combined in conduit 136 and applied, with or without extracting heat, to intermediate pressure stages of solvent vapor turbine 138. Alternatively, the combined solvent stream in line 136 can be applied to a separate organic vapor turbine.

In this example, the vaporized solvent in line 136 gives up heat in heat exchanger 9 to the deasphalted oil/solvent mixture that passes through conduit 8 from asphaltene separator 5 in FIG. 1A to DAO separator 13 in FIG. 1A. Alternatively, before entering an intermediate stage of solvent vapor turbine 138, the combined stream may be supplied to a further heat exchanger (not shown) upstream of preheater 122 for preheating a liquid product stream.

The further reduced solvent liquid product stream of asphaltene from column 128 passes through conduit 129 to flash drum 130, and the further reduced solvent liquid product stream of DAO passes through conduit 169 to flash drum 170. Drum 130 operates at a lower pressure but at the same or a slightly lower temperature than flash drum 128 in order to minimize the amount of solvent in the asphaltene product that leaves unit 100 through conduit 131. Flash drum 170 is also operated at a lower pressure and also at the same or a slightly lower temperature than drum 168 in order to minimize the amount of solvent in the DAO product that leaves unit 100 through conduit 171.

The overhead vapors from flash drums 130 and 170 are preferably combined in conduit 141 and then combined in conduit 142 with the exhaust from solvent vapor turbine 138 in conduit 139. The combined stream in conduit 142 is then cooled for condensing the vaporized solvent before returning the condensed solvent to the solvent drum. Preferably, the combined stream passes through indirect contact heat exchanger 143 containing an organic fluid, preferably pentane, vaporizing it and producing vaporized organic fluid in conduit 148 which is applies to organic vapor turbine 149. The vaporized organic fluid stream expands in this turbine to which generator 149A is coupled producing electric power and expanded vaporized organic fluid in conduit 150. Condenser 151 condenses the expanded organic fluid to organic fluid condensate that is returned by pump 153 to heat exchanger 143.

Second asphaltene flash drum or column 128 may or may not be used as dictated by economic considerations. Likewise, for other product streams, the use of secondary flash drums is dictated by economic considerations.

When all but light solvents are used, solvent recovery section 100 in FIG. 2A will produce asphaltene product in line 131, and DAO product in line 171 with less than about 0.05% by weight residual solvent. This is accomplished by constructing vessels 130 and 170 to operate as steam strippers as shown in FIG. 3. When a light solvent, e.g., propane, is the solvent used in a solvent recovery unit, and condenser 145 (which condenses the solvent vapors before returning them to the solvent drum) is air or water cooled, the condenser must operate at a pressure considerably higher than atmospheric pressure in order for the condensed solvent to remain in a liquid state. Under these conditions, both the asphaltene and DAO product streams produced by flash drums 130 and 170 in FIG. 2A would contain a significant amount of solvent. Thus, when propane is the solvent being used, apparatus 200B shown in FIG. 2B would be employed. In such case, product line 131 applies asphaltene product from drum 130 in FIG. 2A to stripper 180, and product line 171 applies DAO product from drum 170 in FIG. 2A to stripper 190. Strippers 180 and 190 operate slightly above atmospheric pressure and at the same or a slightly lower temperature than flash drums 130 and 170 in order to minimize the amount of light solvent that exits the strippers with the products.

The stripping medium applied to strippers 180 and 190 preferably is saturated or superheated steam at a pressure typically about 300 psig. The stripping medium may be produced, for example, by heat exchange of water with the DAO product, asphaltene product, or any other heat medium that has a sufficiently high temperature.

Figure 2B:
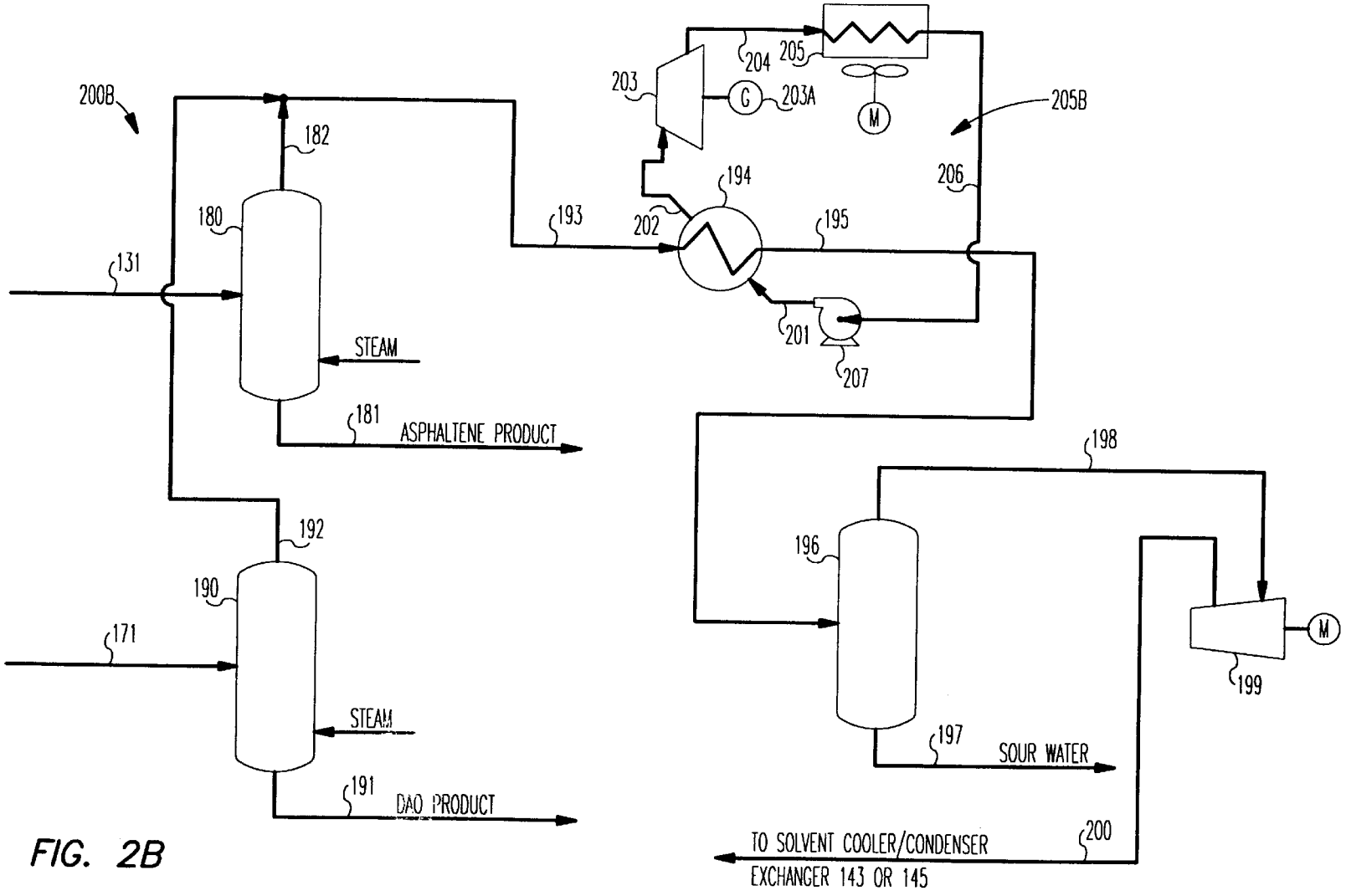
FIG. 2B is a block diagram which represents, in a schematic way a further embodiment of the present invention.
Figure 3:
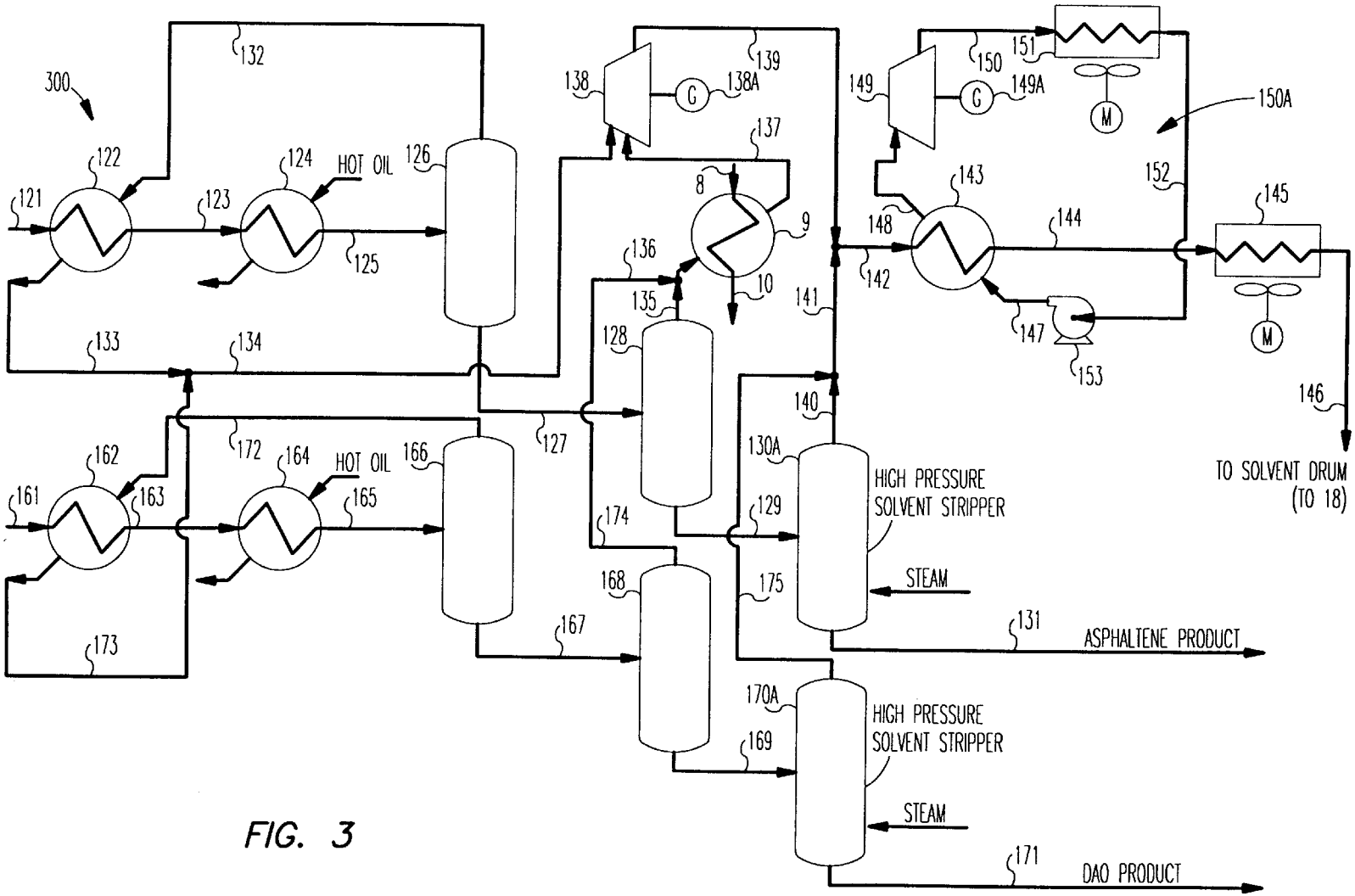
FIG. 3 is a block diagram which represents, in a schematic way a still further embodiment of the present invention.

As shown in FIG. 2B, the overheads from columns 180 and 190, namely steam and vaporized solvent, pass through conduits 182 and 192 respectively, and preferably, are then combined in conduit 193. Preferably, the combined stream is applied to energy converter 205B which operates on a closed Rankine cycle. The combined stream in conduit 193 passes through indirect contact heat exchanger 194 containing an organic fluid, preferably pentane, which is vaporized as the combined stream is cooled.

The vaporized organic fluid is applied to organic vapor turbine 203 coupled to electric generator 203A. After expansion in turbine 203, the expanded organic vapor is condensed at 205, and the organic fluid condensate is pumped back to heat exchanger 194 by pump 207. This aspect of the invention also contemplates replacing organic fluid Rankine cycle converter 205B with an air or water cooler if the economics of the plant so dictate.

The temperature of the steam/solvent mixture exiting heat exchanger 194 through conduit 195 is sufficiently low to condense the steam to sour water, but high enough to prevent condensation of the solvent with the result that two separate phases exist in conduit 195. Column 196 functions as a water knock-out drum separating the cooled solvent vapor which exits the column from the sour water which is removed via conduit 197. The cooled vaporized solvent stream flows through conduit 198 to compressor 199 which pressurizes the solvent vapor to a level high enough to effect its entry into the solvent drum. The pressurization of the stream of solvent vapor also increases the temperature of the vapor. Passing the stream of hot solvent vapor so produced through a heat exchanger condenses the vapor to a liquid so that liquid solvent enters the solvent drum.

In one embodiment of this invention, hot, pressurized solvent vapor flows through conduit 200 at the outlet of compressor 199 and is added to the combined steam in conduit 142 in FIG. 2A. The excess thermal energy of the pressurized solvent is recovered by use of closed organic Rankine cycle 150A. In another embodiment of the invention, the hot pressurized solvent vapor in conduit 200 is directed to the inlet of an air or water cooled heat exchanger such as the one shown in FIG. 2A by reference numeral 145.

Sometimes, the amount of propane that enters the low pressure solvent recovery system does not justify the cost of the compression equipment shown in FIG. 2B. In such a case, the stream of cooled solvent vapor in conduit 198 can be sent directly to a low pressure refinery fuel-gas recovery system where its fuel value can be recovered.

In yet another embodiment of this invention for use when the solvent is a light solvent such as propane, low pressure flash drums shown as columns 130 and 170 in FIG. 2A can be replaced with high pressure solvent strippers designated by reference numerals 130A and 170A in FIG. 3. Such strippers strip the product stream to such low solvent levels that all of the equipment in FIG. 2B can be eliminated.

In addition, while FIGS. 2A, 2B and 3 show turbines 138, 149 and 203 producing electricity by driving generators, the power produced by these turbines can be used as mechanical energy by suitable equipment.

Furthermore, while the embodiments of the present invention described above include turbines and their use to produce mechanical power or electricity, the present invention specifically contemplates the possibility of constructing the apparatus described above without turbines and without their use.

In FIG. 2A, flash drums 126 and 166 would operate at temperatures of 200–600° F. (95–315° C.) and preferably 500–600° F. (260–315° C.). Operating pressures in flash drums 126 and 166 would be between 20 and 350 psig below the critical pressure of the solvent used, and preferably between 20 and 100 psig below the critical pressure of the solvent. In this example, the subsequent flash drums would be operated to optimize power recovery from the turbines present in the system with the pressure of the last flash drum about 15 psig above the vapor pressure of the solvent used at 120° F. (50° C.).

As an example of demonstrating the effectiveness of the present invention, it has been shown that approximately 10% of heat or fuel consumption can be saved when using preheaters or heat exchanger 122 and 162. In addition, the use of the turbines, as disclosed in the present invention, results in the generation of power from heat and pressure available in the system.

The advantages and improved results furnished by the method and apparatus of the present invention are apparent from the foregoing description of the preferred embodiment of the invention. Various changes and modifications may be made without departing from the spirit and scope of the invention as described in the appended claims.

What is claimed is:

1. A method for reducing the heat requirement of a solvent recovery section of a solvent deasphalting unit that produces a plurality of liquid product streams comprising a liquid stream of deasphalted oil and solvent, and a liquid stream of asphaltene and solvent, said method comprising;

a) heating at least one of said liquid product streams for producing a heated liquid product stream;

b) flashing said heated liquid product stream for producing a stream of vaporized solvent, and a reduced solvent liquid product stream;

c) indirectly transferring heat in said stream of vaporized solvent to said at least one of said liquid product streams prior to heating the latter in step a) for preheating said at least one of said liquid product streams and producing a heat depleted stream of vaporized solvent; and d) converting heat in said heat depleted stream of vaporized solvent to power.

2. A method according to claim 1 including expanding said heat depleted stream of vaporized solvent in a solvent vapor turbine for producing power and a stream of expanded vaporized solvent.

3. A method according to claim 2 including:

a) transferring heat in said stream of expanded vaporized solvent to an organic liquid that is vaporized as a result for producing a stream of vaporized organic fluid;

b) expanding said vaporized organic fluid in an organic vapor turbine for producing power and expanded vaporized organic fluid; and c) condensing said expanded vaporized organic fluid to organic fluid liquid.

4. A method according to claim 2 including flashing solvent from said reduced solvent liquid product stream in a temperature range of 0 to 30° C. less than the temperature at which flashing of said heated liquid product stream is effected, and at a pressure which is lower than the pressure of said heated liquid product stream, but higher than the vapor pressure of the solvent at a temperature slightly above ambient temperature, to produce at least one further stream of vaporized solvent and at least one further reduced solvent liquid product stream.

5. A method according to claim 4 including supplying said further stream of vaporized solvent to a solvent vapor turbine.

6. A method according to claim 4 including:

a) using steam to strip solvent from said further reduced solvent liquid product stream at a temperature within about 30° C. of the temperature of first flashing of at least one of said liquid product streams to produce a stream of stripped vaporized solvent containing steam, and a substantially solvent-free product stream; and b) cooling and condensing said stream of stripped vaporized solvent containing steam.

7. A method according to claim 6 including:

a) transferring heat in said stream of stripped vaporized solvent containing steam to an organic liquid that is vaporized as a result for producing a stream of vaporized organic fluid and a stream containing condensed steam and further heat depleted solvent;

b) expanding said vaporized organic fluid in an organic vapor turbine for producing power and expanded organic vapor; and c) condensing said expanded organic vapor to organic fluid condensate.

8. A method according to claim 7 including:

a) separating condensed steam from said further heat depleted solvent stream for producing a stream of condensed steam, and a stream of cooled solvent vapors;

b) compressing said stream of cooled solvent vapors for producing hot compressed solvent vapors; and c) supplying said hot compressed solvent vapors to said expanded vaporized solvent for transferring heat contained in the hot compressed solvent vapors to said organic liquid.

9. A method according to claim 4 including:

a) flashing said further reduced solvent liquid product stream at a temperature within about 30° C. of the temperature of the first flashing of at least one of said liquid product streams, and at a pressure lower than the pressure at which said heated liquid product stream is flashed, to produce another vaporized solvent stream and a further substantially solvent-free product stream; and b) transferring heat in said still further vaporized solvent stream to water or air in an indirect heat exchanger.

10. A method according to claim 4 including supplying said further stream of vaporized solvent to an intermediate stage of said solvent vapor turbine.

11. A method for operating an evaporative solvent recovery section of a solvent deasphalting unit that produces a plurality of liquid product streams comprising a liquid stream of deasphalted oil and solvent, and a liquid stream of asphaltene and solvent, said method comprising:

a) applying heat from an external source to one of said liquid product streams to produce a heated liquid product stream;

b) flashing said heated liquid product stream to produce a vaporized solvent stream and a reduced solvent liquid product stream;

c) processing said reduced solvent liquid product stream to vaporize substantially all of the solvent therefrom without the addition of further significant heat;

d) recovering heat from said vaporized solvent stream; and e) using heat recovered in step d) to generate power.

12. A method according to claim 11 wherein heat is recovered by expanding said vaporized solvent stream in an organic vapor turbine.

13. A method according to claim 11 including preheating said liquid product stream with said vaporized solvent stream for producing a heat depleted vaporized solvent stream, and expanding said heat depleted vaporized solvent stream in an organic vapor turbine.

14. A method according to claim 11 wherein said processing includes:

a) applying said reduced solvent liquid product stream serially to a string of elements each of which is constructed and arranged to produce, from the applied liquid product stream, a vaporized solvent stream, and a reduced solvent liquid product stream;

b) applying the reduced solvent liquid product stream from a preceding element in the string to a succeeding element without significantly heating the reduced solvent liquid product stream; and c) recovering heat from the vaporized solvent stream produced by said elements.

15. Apparatus for reducing the heat requirement of a solvent recovery section of a solvent deasphalting unit that produces a plurality of liquid product streams comprising a liquid stream of deasphalted oil and solvent, and a liquid stream of asphaltene and solvent, said apparatus comprising:

a) a heater for heating at least one of said liquid product streams for producing a heated liquid product stream;

b) a first flash drum for flashing said heated liquid product stream to produce a stream of vaporized solvent, and a reduced solvent liquid product stream;

c) a preheater upstream of said heater for preheating said at least one liquid product streams using heat contained in said stream of vaporized solvent and producing a heat depleted stream of vaporized solvent; and d) means responsive to said heat depleted stream of vaporized solvent for generating power and further heat depleted vaporized solvent.

16. Apparatus according to claim 15 including a solvent vapor turbine for expanding said heat depleted stream of vaporized solvent to produce power and a stream of expanded vaporized solvent.

17. Apparatus according to claim 16 including cooling apparatus for cooling and condensing said stream of expanded vaporized solvent, said cooling apparatus including:

a) an indirect contact heat exchanger containing organic liquid for receiving said stream of expanded vaporized solvent and vaporizing said organic liquid and producing a stream of vaporized organic fluid;

b) an organic vapor turbine for expanding said vaporized organic fluid and producing power and expanded vaporized organic fluid;

c) a condenser for condensing said expanded vaporized organic fluid to organic fluid condensate; and d) means for returning said condensate to said heat exchanger.

18. Apparatus according to claim 17 including at least one subsequent flash drum for flashing said reduced solvent liquid product stream at a temperature range of 0 to 30° C. less than the operating temperature of the first flash drum, and at a pressure lower than the operating pressure of said first flash drum, but higher than the vapor pressure of the solvent at a temperature slightly above ambient temperature, to produce at least one further stream of vaporized solvent and at least one further reduced solvent liquid product stream, and means for supplying said at least one further stream of vaporized solvent to an intermediate stage of said solvent vapor turbine.

19. Apparatus according to claim 18 including:

a) a stripper to which steam is supplied for stripping solvent from said further reduced solvent liquid product stream at a temperature within 30° C. of the operating temperature of said flash drum of the first flashing of at least one of the said liquid product streams to produce a stream of stripped vaporized solvent containing steam and a substantially solvent-free product stream; and b) means for cooling and condensing said stream of stripped vaporized solvent containing steam.

20. Apparatus according to claim 19 including:

a) a separator for separating condensed steam from said further heat depleted solvent stream to produce a stream condensed steam and a stream of cooled solvent vapors;

b) a compressor for compressing said stream of cooled solvent vapors for producing hot compressed solvent vapors; and c) means for supplying said hot compressed solvent vapors to said expanded vaporized solvent for transferring heat contained in the hot compressed solvent vapors to said organic fluid.

21. Apparatus according to claim 20 wherein said solvent is selected from the class of solvents consisting of propane, iso-butane, normal butane, iso-pentane, and normal pentane.

22. Apparatus according to claim 19 including a flash drum for flashing said substantially solvent-free product stream at a temperature within about 30° C. of the operating temperature of said first flash drum to produce another vaporized solvent stream and a further substantially solvent-free product stream.

23. A method for reducing the heat requirement of a solvent recovery section of a solvent deasphalting unit that produces a plurality of liquid product streams comprising a liquid stream of deasphalted oil and solvent, and a liquid stream of asphaltene and solvent, said method comprising:

a) heating at least one of said liquid product streams for producing a heated liquid product stream;

b) flashing said heated liquid product stream for producing a stream of vaporized solvent, and a reduced solvent liquid product stream;

c) indirectly transferring heat in said stream of vaporized solvent to said at least one of said liquid product streams prior to heating the latter in step a) for preheating said at least one of said liquid product streams and producing a heat depleted stream of vaporized solvent; and d) flashing solvent from said reduced solvent liquid product stream in a temperature range of 0 to 30° C. less than the temperature at which flashing of said heated liquid product stream is effected, and at a pressure which is lower than the pressure of said heated liquid product stream, but higher than the vapor pressure of the solvent at a temperature slightly above ambient temperature, to produce at least one further stream of vaporized solvent and at least one further reduced solvent liquid product stream.

24. A method according to claim 23 including expanding said heat depleted stream of vaporized solvent in a solvent vapor turbine for producing power and a stream of expanded vaporized solvent.

25. Apparatus for reducing the heat requirement of a solvent recovery section of a solvent deasphalting unit that produces a plurality of liquid product streams comprising a liquid stream of deasphalted oil and solvent, and a liquid stream of asphaltene and solvent, said apparatus comprising:

a) a heater for heating at least one of said liquid product streams for producing a heated liquid product stream;

b) a first flash drum for flashing said heated liquid product stream to produce a stream of vaporized solvent, and a reduced solvent liquid product stream;

c) a preheater upstream of said heater for preheating said at least one liquid product streams using heat contained in said stream of vaporized solvent and producing a heat depleted stream of vaporized solvent; and d) at least one subsequent flash drum for flashing said reduced solvent liquid product stream at a temperature range of 0 to 30° C. less than the operating temperature of the first flash drum, and at a pressure lower than the operating pressure of said first flash drum, but higher than the vapor pressure of the solvent at a temperature slightly above ambient temperature, to produce at least one further stream of vaporized solvent and at least one further reduced solvent liquid product stream.

26. Apparatus according to claim 25 including a solvent vapor turbine for expanding said heat depleted stream of vaporized solvent to produce power and a stream of expanded vaporized solvent.

27. A method for operating an evaporative solvent recovery section of a solvent deasphalting unit that produces a plurality of liquid product streams comprising a liquid stream of deasphalted oil and solvent, and a liquid stream of asphaltene and solvent, said method comprising:

a) applying heat from an external source to one of said liquid product streams to produce a heated liquid product stream;

b) flashing said heated liquid product stream to produce a vaporized solvent stream and a reduced solvent liquid product stream;

c) processing said reduced solvent liquid product stream to vaporize substantially all of the solvent therefrom without the addition of further significant heat;

d) recovering heat from said vaporized solvent stream by preheating said liquid product stream with said vaporized solvent stream for producing a heat depleted vaporized solvent stream, and expanding said heat depleted vaporized solvent stream in an organic vapor turbine; and e) flashing solvent from said reduced solvent liquid product stream in a temperature range of 0 to 30° C. less than the temperature at which flashing of said heated liquid product stream is effected, and at a pressure which is lower than the pressure of said heated liquid product stream, but higher than the vapor pressure of the solvent at a temperature slightly above ambient temperature, to produce at least one further stream of vaporized solvent and at least one further reduced solvent liquid product stream.

28. A method according to claim 27 including expanding said at least one further stream of vaporized solvent in an organic vapor turbine.

* * * * *